US010258149B2

(12) United States Patent
Zhong

(10) Patent No.: US 10,258,149 B2
(45) Date of Patent: Apr. 16, 2019

(54) LIFTING DESKTOP WITH A COMPACT STRUCTURE

(71) Applicant: HANGZHOU LANDA CRAFTS CO., LTD., Hangzhou, Zhejiang Province (CN)

(72) Inventor: Xinghua Zhong, Hangzhou (CN)

(73) Assignee: HANGZHOU LANDA CRAFTS CO., LTD. (CN)

( * ) Notice: Subject to any disclaimer, the term of this patent is extended or adjusted under 35 U.S.C. 154(b) by 0 days.

(21) Appl. No.: 15/784,956

(22) Filed: Oct. 16, 2017

(65) Prior Publication Data

US 2018/0103752 A1 Apr. 19, 2018

(30) Foreign Application Priority Data

Oct. 18, 2016 (CN) ..... 2016 1 0907361
Mar. 16, 2017 (CN) ..... 2017 2 0256059 U

(51) Int. Cl.
*A47B 9/16* (2006.01)
*A47B 9/02* (2006.01)
(Continued)

(52) U.S. Cl.
CPC ..... *A47B 9/16* (2013.01); *A47B 3/02* (2013.01); *A47B 9/02* (2013.01); *A47B 3/0812* (2013.01);
(Continued)

(58) Field of Classification Search
CPC ..... A47B 1/03; A47B 21/0314; A47B 21/00; A47B 21/02; A47B 21/03; A47B 9/16;
(Continued)

(56) References Cited

U.S. PATENT DOCUMENTS 3,219,338 A * 11/1965 Kastner ..... B26D 3/003 270/30.09
4,558,648 A * 12/1985 Franklin ..... B66F 7/065 108/136
(Continued)

FOREIGN PATENT DOCUMENTS

DE 19537159 * 12/1996
WO 9117906 * 11/1991

OTHER PUBLICATIONS

CN 206953123; Xiao H; abstract and drawing (Year: 2018).*

*Primary Examiner* — Janet M Wilkens
(74) *Attorney, Agent, or Firm* — PROI Intellectual Property US

(57) ABSTRACT

A lifting desktop comprises a desktop platform, a base frame below the desktop platform, and two sets of assemblies. Each set of assemblies include a support frame assembly, an assistance assembly and a locking assembly. The two sets of assemblies are symmetrically arranged on two sides between the base frame and the desktop platform. The base frame comprises lower side-plates, and the desktop platform comprises upper side-plates. Each of the support frame assemblies comprises two support legs which are pivoted to each other in scissors by a central pivot and spanned on two sides of the respective lower side-plate. Each of the support legs has a fixed pivot end pivoted to the respective lower side-plate or upper side-plate and a free end movably connected to the opposite upper side-plate or lower side-plate on the same side.

19 Claims, 11 Drawing Sheets

(51) Int. Cl.

| | |
|---|---|
| ***A47B 3/02*** | (2006.01) |
| *A47B 21/02* | (2006.01) |
| *A47B 9/10* | (2006.01) |
| *A47B 3/08* | (2006.01) |

(52) U.S. Cl.
CPC ..... *A47B 9/10* (2013.01); *A47B 21/02* (2013.01); *A47B 2003/025* (2013.01)

(58) Field of Classification Search
CPC .... A47B 2021/0321; A47B 2021/0364; A47B 3/02; A47B 3/0809; A47B 3/0815; A47B 2003/025; A47B 19/08; A47B 83/02; A47B 23/001; A47B 1/056; A47B 1/04; A47B 1/02; A47B 3/12; A47B 3/06; A47B 87/002; A47B 12/088; F16M 11/24; F16M 11/2014; F16M 11/2092; F16M 11/38
USPC ..... 312/208.1, 223.3, 306, 312, 194–196; 108/144.11, 145, 147, 93, 96, 116–118, 108/120, 43, 138, 50.01, 50.02, 14, 13, 108/11, 4, 9, 10, 33, 39, 146
See application file for complete search history.

(56) References Cited

U.S. PATENT DOCUMENTS

| | | | | | |
|---|---|---|---|---|---|
| 4,741,512 | A * | 5/1988 | Elkuch | B66F 7/065 | 248/421 |
| 5,400,720 | A * | 3/1995 | Stevens | A47B 9/16 | 108/147 |
| 5,695,173 | A * | 12/1997 | Ochoa | B66F 7/065 | 254/10 C |
| 5,823,120 | A * | 10/1998 | Holmquist | A47B 9/02 | 108/147 |
| 6,672,430 | B2 * | 1/2004 | Boucher | B66F 7/065 | 108/145 |
| 9,326,598 | B1 * | 5/2016 | West | A47B 3/02 | |
| 9,504,316 | B1 * | 11/2016 | Streicher | A47B 21/02 | |
| 9,815,672 | B2 * | 11/2017 | Baudermann | B66F 7/0625 | |
| 2003/0154890 | A1 * | 8/2003 | Warner | A47B 9/00 | 108/145 |
| 2005/0120922 | A1 * | 6/2005 | Brooks | A47B 3/02 | 108/118 |
| 2013/0341984 | A1 * | 12/2013 | Olesen | A61G 5/1059 | 297/344.15 |
| 2017/0174486 | A1 * | 6/2017 | Kochie | B66F 7/065 | |
| 2017/0340104 | A1 * | 11/2017 | Chuang | A47B 9/16 | |

* cited by examiner

LIFTING DESKTOP WITH A COMPACT STRUCTURE

CROSS REFERENCE TO RELATED APPLICATIONS

The present application claims priority to Chinese Patent Application CN 201610907361.3 filed on Oct. 18, 2016 and to Chinese Patent Application CN 201720256059.6 filed on Mar. 16, 2017.

TECHNICAL FIELD OF THE INVENTION

The present invention relates to office furniture, and in particular to a height-adjustable desktop device appropriate for persons of different heights or appropriate for working while sitting or standing.

BACKGROUND OF THE INVENTION

With the development of society, the occurrence of occupational diseases is on the rise. Conventional office desks are constant in height; or, their height may be customized during manufacturing, but it is difficult to change the height once they are delivered. Office workers are very easy to have occupational diseases at their waist, back, neck or legs if they work on an office desk at the same height for a long period of time. Since such occupational diseases resulted from long-time sitting have troubled many workers, standing office or alternate sitting and standing office first becomes popular abroad. This office style has various advantages. Particularly, this office style may avoid the occurrence of some lumber and cervical spondylosis and also has a certain effect of losing weight. Research reports have indicated that this office style may also improve the working efficiency by 10% to 30%.

Due to the problem of inappropriate desktop height resulted from the change between the standing office and the sitting office, various height-adjustable desktop products have been provided. Chinese Patent Publication CN102715729B has disclosed a lifting desktop, wherein two support legs are in transmission connection to one another successively by a motor, a speed reducer and a screw so that the desktop is lifted electrically. With this technical solution, the lifting desktop is very compact in a folded state and will not influence the normal use of the original desk when it is placed on the desk. The height to be adjusted is freely selected by electrically or manually driving the screw, and it is thus convenient to change between the standing office and the sitting office. However, this technical solution has the disadvantage of low speed in lifting the desktop, due to the driving by the screw. Moreover, electrical driving is costly, whereas manually shaking the screw requires good physical fitness of a user.

U.S. Pat. No. 9,504,316B1 has disclosed a height adjustable desktop assembly. The technical solution of this patent includes a desktop support, a base frame, support frames which are provided between the desk support and the base frame and pivoted to each other in an X-shaped form, and hydraulic cylinders connected to the base frame and a position close to a middle portion of one support leg of the support frames. The technical solution of this U.S. patent also has various disadvantages: firstly, when the desktop is actuated from a folded state, the hydraulic cylinders provide limited assistance in lifting the desktop since they are approximately horizontally arranged, and additionally, it is difficult to manually lift the desktop due to the weight of objects on the desktop; and secondly, since it is difficult to completely unfold the desktop due to the presence of the central pivot in the middle of the X-shaped support frames, the structure is not compact and the normal use of the original desk is influenced. As far as the present applicant knew, European Patent Publication No. EP0937677A2 has disclosed scissor lifts. The lift includes two support legs crossing each other, wherein each of the support legs is provided with a roll end and a fixed pivot end; a connecting rod is pivoted onto one of the support legs; one end of the connecting robe is provided with a roller and resisted against the other support leg, while the other end thereof is pivoted to a piston rod; and, the other end of the piston rod is pivoted to the other support leg. In the technical solution, an upward thrust force is generated by a connecting rod under the action of the piston rod, so that an actuating assistance is provided to the lift during the actuation. However, since the piston rod is arranged between two support legs on a same side, there will be the following disadvantages: firstly, the lifting assistance to the lift is not satisfactory during the lifting process of the lift after actuation, because no sufficient torque is provided to the support legs; secondly, since the piston rod is arranged between two support legs on a same side, the maximum extension length of the piston rod is limited, and the lifting height of the lift is thus influenced; and thirdly, due to the arrangement of the connecting rod structure and the piston rod, the lift cannot be unfolded completely, resulting in poor structural compactness. Therefore, this technical solution cannot be applied to a lifting structure of a lifting desktop.

SUMMARY OF THE INVENTION

An objective of the present invention is to solve at least the problems and/or deficiencies and provide at least the advantages described hereinafter.

Another objective of the present invention is to provide a lifting desktop with a compact structure. In view of the technical problems of the non-compact structure in a folded state, the difficulty in lifting the desktop resulted from small lifting assistance and the difficulty in actuation when completely folded, the structure of a base frame and the arrangement of support frame assemblies are improved to allow the panel of the desktop and the base frame to be folded completely. By improving the structure and connection arrangement of assistance assemblies, the desktop is allowed to obtain well assistance from the actuation in the folded state to the normal lifting, so that it is very easy to lift the desktop.

To solve the technical problems, particularly to solve the problem of structure compactness when the desktop is folded completely, the present invention provides a lifting desktop with a compact structure, including a desktop platform, a base frame below the desktop platform, and two sets of support frame assemblies, assistance assemblies and locking assemblies which are symmetrically arranged on two sides between the base frame and the desktop platform, wherein the base frame includes lower side-plates, and the desktop platform includes upper side-plates; each of the support frame assemblies includes two support legs which are pivoted to each other in scissors by a central pivot and spanned on two sides of the respective lower side-plate; each of the support legs has a fixed pivot end pivoted to the respective lower side-plate or upper side-plate and a free end movably connected to the opposite upper side-plate or lower side-plate on the same side; one end of each of the assistance assemblies is pivoted to the support leg on a side close to the free end, while the other end thereof is pivoted to the lower side-plate or upper side-plate on a side of the fixed pivot end of the same support leg; and, central slots for accommodating the central pivot are provided on the lower side-plates. With the separate arrangement of the support legs on two sides of the opposite lower side-plates and the arrangement of the central slots, the support frame assemblies are folded completely, and the whole lifting desktop is very flat, so that the lifting desktop is more compact and concise when placed on an original desktop and will not cause any adverse effect on the environment of the original desktop. The arrangement of the lifting desktop allows the office desk to adapt to persons of different heights or adapt to different office postures, so that the occurrence of occupational diseases is reduced and the working efficiency is improved.

In order to easily lift the completely folded lifting desktop, decrease the operating intensity of a user and realize easy lifting experience, preferably, each of the assistance assemblies includes an elastic element and an actuating lever at least pivoted to one end of the elastic element; the actuating lever is provided with a ram portion and an arm-of-force portion, a fulcrum pivot is provided on the arm-of-force portion, and the elastic element is pivoted onto the arm-of-force portion, so that a thrust force applied to the arm-of-force portion by the elastic element allows the ram portion to rotate about the fulcrum pivot towards a plane bearing the base frame or a bottom surface of the desktop platform; and, the elastic element includes a pneumatic cylinder, a hydraulic cylinder or a compression spring.

Specifically, in order to satisfy the requirement for more compact structure of the lifting desktop in the folded state and meet the requirement on the actuating torque and lifting force applied by the actuating lever to the desktop, the lifting desktop further includes a limiting pin for limiting the swing angle for the rotation of the actuating lever, and the swing angle of the actuating lever about the fulcrum pivot is 60° to 120°. Preferably, the swing angle of the actuating lever relative to the fulcrum pivot is 90°.

The movable connection at the free end of each of the support legs may be rolling connection of a roller and a plane. Preferably, a movable connection structure for the free end of each of the support legs includes an upper sliding chute provided on the upper side-plate, a lower sliding chute provided on the lower side-plate on the same side, and a sliding pin provided at the free end of the support leg. With the movable connection structure, the connection of the support legs and the upper side-plates or the lower side-plates is more reliable.

The lifting position of the lifting desktop may be continuously positioned at any position by the locking assemblies. However, in order to make the locking structure simpler and more reliable, the lifting and positioning of the present invention are realized by a stepped locking structure; moreover, in this solution, the stepped locking structure is arranged in accordance with the principle that the unit lifting height progressively increases stepwise or progressively decreases stepwise. With the structure, the desktop platform is allowed to have a large lifting height in the initial stage so that it is more convenient for preliminary adjustment; moreover, the progressive decrease of the lifting height allows the height adjustment in the later lifting stage to be more precise. Each of the locking assemblies includes a pin assembly arranged on the bottom surface of the desktop platform and a locking bar connected to the free end of the support leg; a number of locking pin holes are formed on the locking bar, and the locking pin holes are arranged at an equal interval B; and, the unit lifting height of the desktop is stepped: $h_n=R-\sqrt{R^2-(R-nB)^2}-h_{n-1}$, where n is the step number, B is the interval between the locking pin holes and R is the half length of the support leg.

As another solution for the stepped locking structure for lifting and positioning in the present invention, the desktop platform is lifted equidistantly stepwise; each of the locking assemblies includes a pin assembly arranged on the bottom surface of the desktop platform and a locking bar connected to the free end of the support leg; a number of locking pin holes are formed on the locking bar, and the locking pin holes are arranged at an equal interval B: $B_n=R-\sqrt{R^2-(nh)^2}-B_{n-1}$, where R is the half length of the support leg, h is the unit limiting height and n is the step number. The solution of equidistantly lifting the desktop platform stepwise is suitable for the height adjustment of the desktop for users of different heights in a sitting posture and also suitable for the height adjustment of the desktop in a standing posture.

When the support frame assemblies are folded to allow the bottom surface of the desktop platform to resist against the roller at the free end of the ram portion, a turning force will be generated since the elastic element pushes the actuating lever. In order to realize more reliable locking, when the desktop platform is subject to a large resilience force applied by the actuating lever after the support frame assemblies are completely folded, not only based on the locking effect generated by the fitting of the locking pin holes on the locking bar with a pin, and to solve the problem that it is difficult to lock the support frame assemblies in the completely folded state by a locking pin and locking pin holes since the interval between the non-equidistant locking pin holes on the locking bar is too small when the desktop is lifted equidistantly stepwise, each of the locking assemblies further includes a locking hook provided at a head end of a press plate of the pin assembly and a lock catch which is provided on the lower side-plate and corresponds to and adapts to the locking hook.

To solve the technical problems, particularly to solve the problem that it is difficult to actuate the lifting desktop after folded completely due to small actuating torque, the present invention provides a lifting desktop with a compact structure, including a desktop platform, a base frame below the desktop platform, and two sets of support frame assemblies and locking assemblies which are arranged between the desktop platform and the base frame, wherein a pneumatic cylinder and an actuating lever are provided between the desktop platform and the base frame; an upper end of the pneumatic cylinder is pivoted to the desktop platform; the actuating lever is a rod with obtuse corner consisting of an arm-of-force portion and a ram portion, and the actuating lever is pivoted onto the support frame assemblies by using its corner as a fulcrum pivot; a free end of the arm-of-force portion is pivoted to a lower end of the pneumatic cylinder; and, a free end of the ram portion can act on a bottom surface of the desktop platform in the starting stage of unfolding the support frame assemblies. In this technical solution, by using a rod with obtuse corner as an actuating lever structure and providing the actuating lever structure by using its corner as a fulcrum pivot, the lifting desktop is allowed to have a large torque in the completely folded state to lift the desktop platform, and the requirements of the compact fitting of the actuating lever in the folded state with the support frame assemblies and the compactness of the overall structure of the lifting desktop are satisfied.

As a preferred technical solution for solving the technical problem of completely folding the lifting desktop, the desktop platform includes upper side-plates separately arranged on two sides, and the base frame includes lower side-plates separately arranged on two sides; each of the support frame assemblies includes two support legs which are pivoted to each other in scissors by a central pivot and spanned on two sides of a lower side-plate of the base frame; each of the support legs has a fixed pivot end pivoted to the lower side-plate or upper side-plate and a free end movably connected to the opposite upper side-plate or lower side-plate on the same side; and, a central slot for accommodating the central pivot is provided in the middle of each of the lower side-plates. With the separate arrangement of the support legs on two sides of the opposite lower side-plates and the arrangement of the central slots, the support frame assemblies are allowed to be folded completely, and the whole lifting desktop is very flat, so that the lifting desktop is more compact and concise when placed on an original desktop.

In the technical solutions of the present invention, in view of the technical problems of the non-compact structure in a folded state, the difficulty in lifting the desktop resulted from small lifting assistance and the difficulty in actuation after complete unfolding, the structure of the base frame and the arrangement of the support frame assemblies are improved to allow the panel of the desktop and the base frame to be folded completely. By improving the structure and connection arrangement of the assistance assemblies, the desktop is allowed to obtain well assistance from the actuation in the folded state to the normal lifting, so that it is very easy to lift the desktop.

in which: 1: desktop platform; 11: upper support frame; 111: upper side-plate; 112: upper sliding chute; 12: desk panel; 2: base frame; 21: lower side-plate; 22: lower sliding chute; 23: central slot; 3: support frame assembly; 31: support leg; 311: fixed pivot end; 312: free end; 313: sliding pin; 32: balance bar; 33: central pivot; 4: assistance assembly; 41: elastic element; 42: actuating lever; 421: arm-of-force portion; 422: ram portion; 43: limiting pin; 44: roller; 45: fulcrum pivot; 5: locking assembly; 51: pin assembly; 511: press plate; 512: locking pin bracket; 513: locking pin; 514: return spring; 515: locking hook; 516: transverse pin; 52: locking bar; 521: locking pin hole; 53: lock catch; B: pin holes span; R: half length of the support leg; h: unit lifting height; and, n: step number.

DETAILED DESCRIPTION OF THE INVENTION

The technical solutions of the present invention will be further described below by specific embodiments with reference to the accompanying drawings.

Embodiment 1

Figure 1:
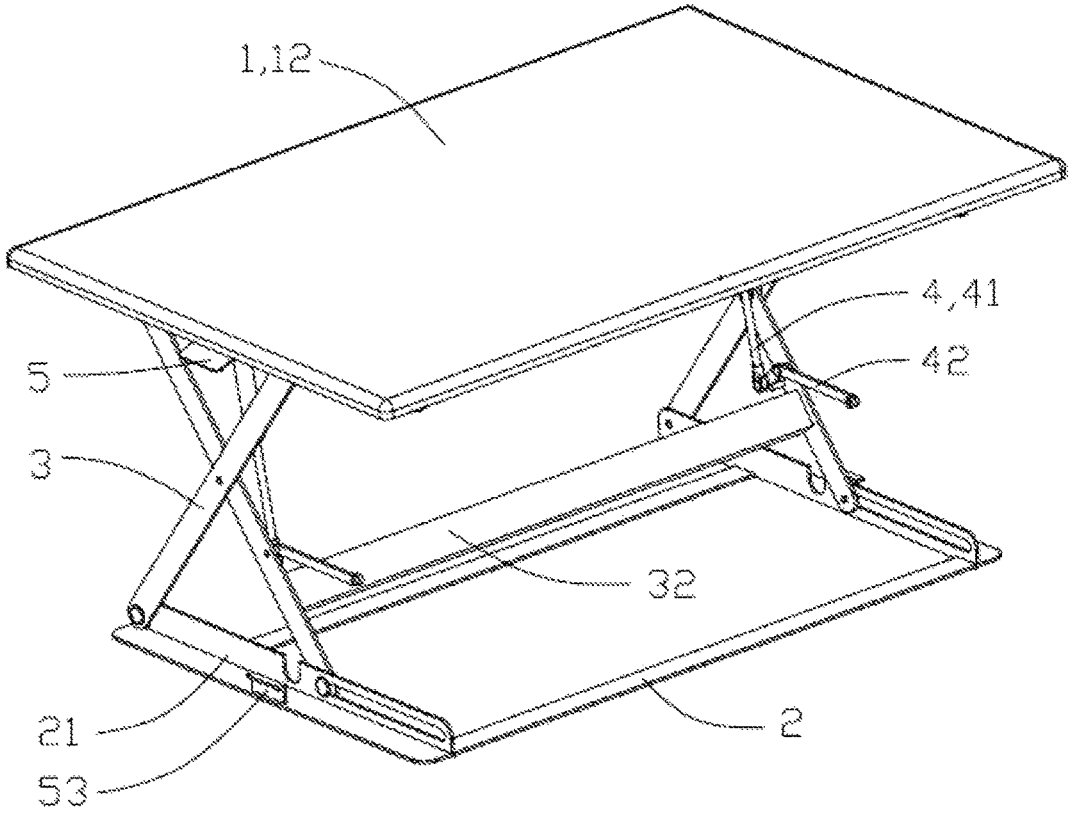
FIG. 1 is a structural diagram according to a first embodiment of the present invention.
Figure 2:
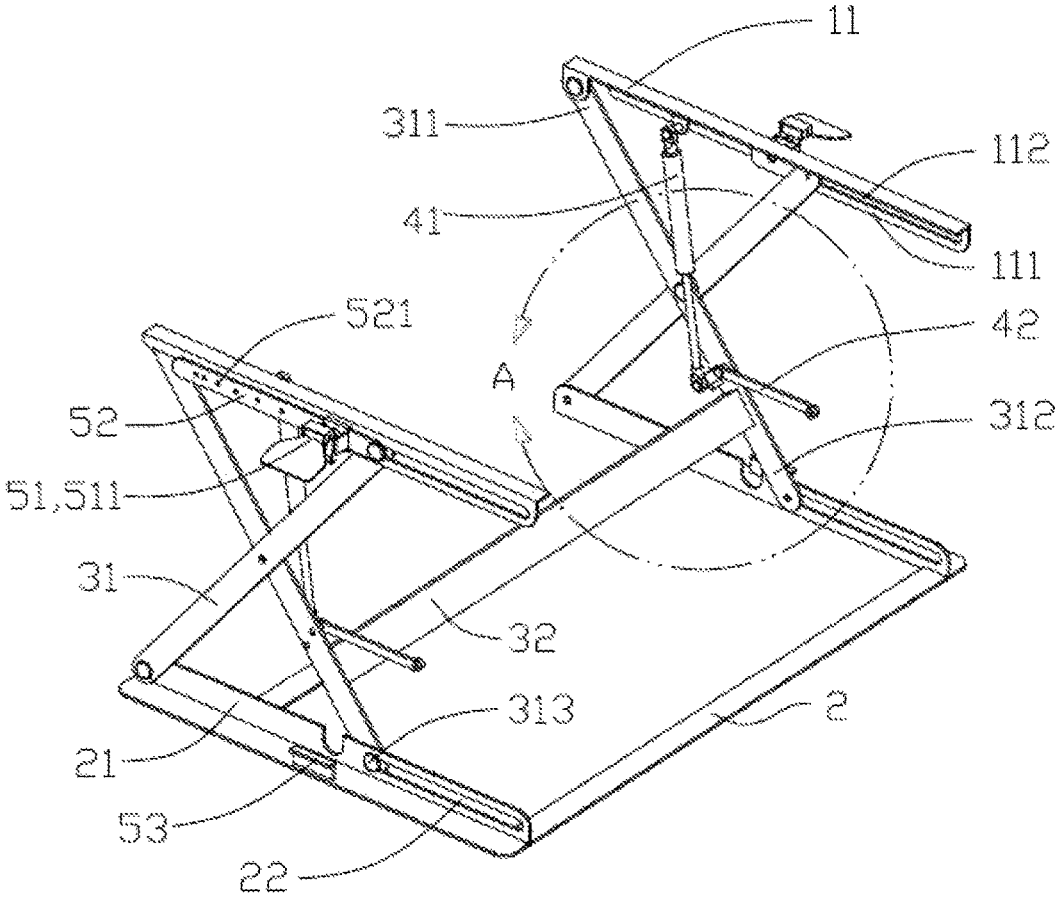
FIG. 2 is a structural diagram according to the first embodiment of the present invention, where a desk panel is removed.

Referring to FIGS. 1 and 2, a lifting desktop with a compact structure is provided, including a desktop platform 1, a base frame 2 below the desktop platform 1, support frame assemblies 3 provided between the desktop platform 1 and the base frame 2, assistance assemblies 4 provided between the desktop platform 1 and the support frame assemblies 3, and locking assemblies 5 for positioning and locking the support frame assemblies 3. The desktop platform 1 includes an upper support frame 11 and a desk panel 12 fixed on the upper support frame 11. The upper support frame 11 includes upper side-plates 111 symmetrically arranged on two sides, and the base frame 2 includes lower side-plates 21 symmetrically arranged on two sides. The upper side-plates 111 and the lower side-plates 21 are in up-and-down correspondence.

Figure 3:
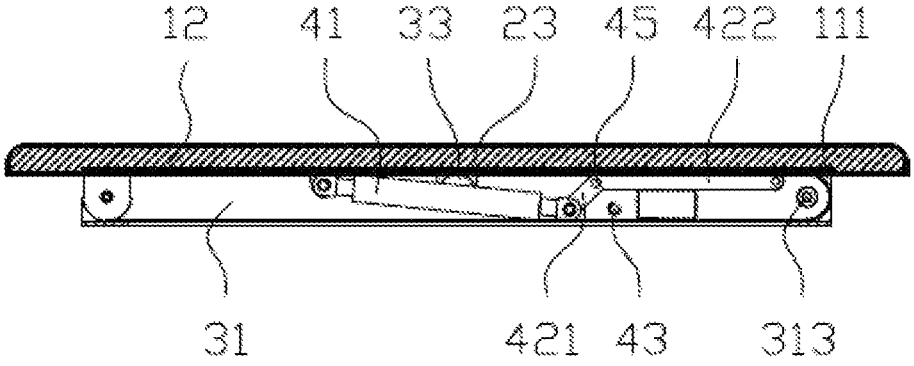
FIG. 3 is a structural diagram according to the first embodiment of the present invention, where support frame assemblies are completely folded.

There are two sets of support frame assemblies 3 which are provided between the upper side-plates 111 and the lower side-plates 21 on two sides, respectively. Each of the support frame assemblies 3 includes two support legs 31. Each of the support legs 31 is provided with a fixed pivot end 311 and a free end 312. The two support legs 31 on each side are crossly pivoted to each other in X-shaped scissors by a central pivot 33. The fixed pivot ends 311 of the two support legs 31 are pivoted to ends of the upper side-plate 111 and the lower side-plate 21 in a same direction, respectively, and are in up-and-down correspondence. The free ends 312 of the two support legs 31 in each side are movably connected to ends of the upper side-plate 111 and the lower side-plate 21 in another direction, respectively, and are in up-and-down correspondence. In this embodiment, an upper sliding chute 112 is provided on the upper side-plate 111 connected to the free end 312 of one support leg 31, a lower sliding chute 22 is provided on the lower side-plate 21 connected to the free end 312 of the other support leg 31, and sliding pins 313 are provided on the free ends 311 of both the support legs 31. The free end 312 of each support leg 31 is slidingly connected to the respective upper sliding chute 112 and lower sliding chute 22 through the sliding pin 313. When the support legs 31 are rotated about the central pivot 33 as an axis, the desktop platform 1 does an up-and-down lifting motion relative to the base frame 2, and the free ends 312 of the support legs 31 do a back-and-forth motion under the limit of the upper sliding chute 112 and the lower sliding chute 22. The lower side-plate 21 is a section bar having an L-shaped cross-section, the two support legs 31 of each of the support frame assemblies 3 are separated apart by a spacer and spanned on two sides of the respective lower side-plate 21, and a central slot 23 is formed in the middle of the lower side-plate 21. Referring to FIG. 3, when the support frame assemblies 3 is completely folded, the central pivot 33 of the support frame assemblies 3 corresponds to the central slot 23 and may be accommodated into the central slot 23, so that the two support legs 31 of the support frame assemblies 3 are folded in parallel to the lower side-plate 21 and the upper side-plate 111. With this lifting structure, the structure of the lifting desktop is very compact, and the lifting desktop will not influence the normal use of the original desk.

Figure 4:
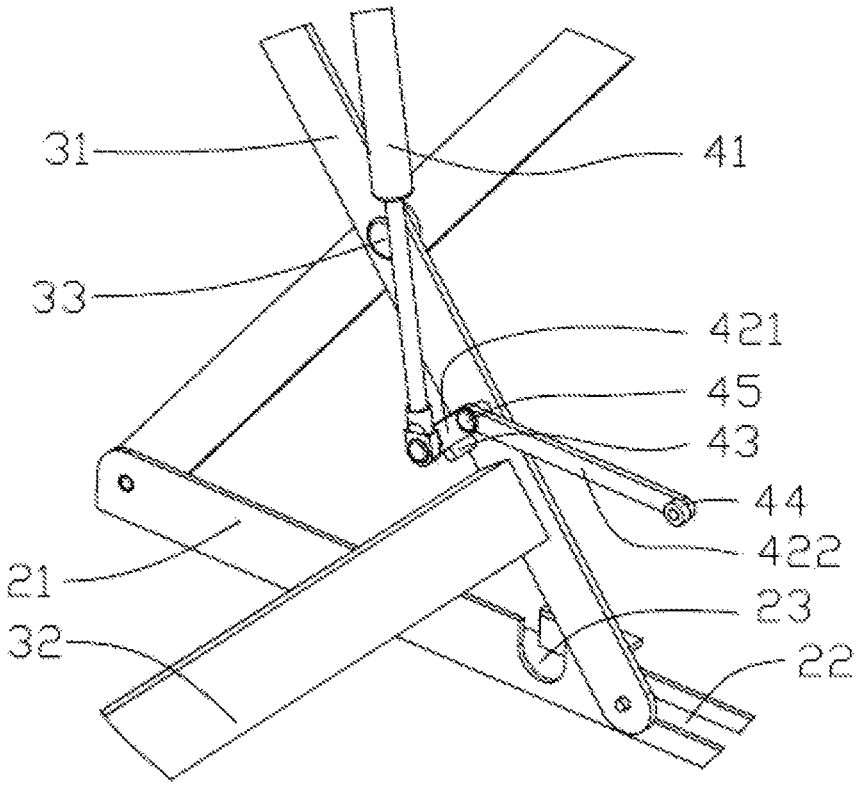
FIG. 4 is an enlarged view of part A in FIG. 2, where a connection structure, on support legs, for an elastic element and an actuating lever is shown.
Figure 5:
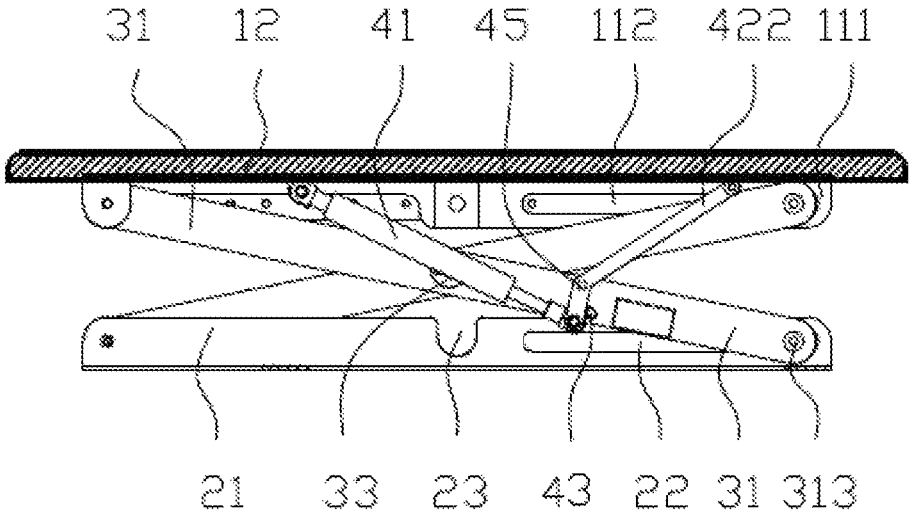
FIG. 5 is a structural diagram according to the first embodiment of the present invention, where the actuating lever of an assistance assembly is in a normal lifting state after the actuation of the desktop is completed.

With the very compact lifting structure, more effective assistance assemblies 4 are required to lift the desktop by a very small artificial force. Therefore, in this embodiment, the assistance assemblies 4 are arranged between the support legs 31 close to the free ends 312 and the upper side-plates 111 on a side of the fixed pivot end of the same support leg. With the arrangement of the assistance assemblies 4, the assistance assemblies 4 are allowed to generate a torque at both ends of the central pivot 33 of the support legs 31, so that the maximum torque is provided and the very effective assistance effect is realized. Moreover, with the arrangement of the assistance assemblies 4, when the support frame assemblies 3 are folded, the assistance assemblies 4 are nearly parallel to the upper side-plates 111 and the lower side-plates 21 to realize the compact folded structure. Each of the assistance assemblies 4 includes an elastic element 41 and an actuating lever 42. Since the elastic element 41 is approximately horizontally arranged when the support frame assemblies 3 are folded, the outward thrust force of the elastic element 41 is insufficient to apply an upward force to the support legs 31. With the arrangement of the actuating lever 42, the elastic element 41 is allowed to convert the horizontal thrust force in the folded state of the support frame assemblies 3 into an upward actuating force. In this embodiment, the elastic element 41 is a pneumatic cylinder. However, the elastic element 41 may also be a hydraulic cylinder or compression spring for generating a thrust force. Referring to FIGS. 2 and 4, the actuating lever 42 is provided with a ram portion 422 and an arm-of-force portion 421. One end of the elastic element 41 is pivoted to the upper side-plate 111 of the desktop platform 1, while the other end thereof is pivoted to one end of the arm-of-force portion 421; and, the other end of the arm-of-force portion 421 is designed as a rotary fulcrum pivot 45. The hinge joint of the elastic element 41 on the upper side-plate 111 is located on an inner side of the hinge joint of the support leg 31 on the upper side-plate 111. The actuating lever 42 is pivoted onto the support leg 31 close to the free end 312 by the fulcrum pivot 45. With the arrangement of the fulcrum pivot 45, the thrust force from the elastic element 41 allows the free end of the ram portion 422 of the actuating lever 42 to always tend to resist against the desktop platform 1 or a plane for bearing the base frame 2. In this embodiment, the fulcrum pivot 45 of the actuating lever 42 is a junction of the arm-of-force portion 421 and the ram portion 422, and the free end of the ram portion 422 tends to resist against the bottom surface of the desktop platform 1. Generally, in order to realize a compact structure by the rotatable fitting of the actuating lever 42 with the elastic member 41, when the support leg assemblies 3 are completely folded, the fulcrum pivot 45 of the actuating lever 42 is arranged within a height range of the upper side-plate 111 or the lower side-plate 22 as far as possible. Generally, the swing angle of the arm-of-force portion 421 relative to the fulcrum pivot 45 should be controlled to be 60° to 110° in order to allow the actuating lever 42 to obtain a large actuating torque by the arm-of-force portion 421. In this embodiment, the swing angle is 90°. Therefore, in this embodiment, the actuating lever 42 is a rod with obtuse corner, and the included angle between the arm-of-force portion 421 and the ram portion 422 is 135°. In order to reduce the friction of the free end of the ram portion 422 with the resisted plane, a roller 44 is provided at the free end of the ram portion 422. Referring to FIG. 5, when the actuating lever 42 completes the actuation of the desktop platform 1, the lifting desktop is in a normal lifting state. In order to control the swing angle of the actuating rod 42 and further realize a support point of force when the elastic element 41 normally lifts the desktop platform, a limiting pin 43 is provided on the support leg 31, and the limiting pin 43 is located in front of the arm-of-force portion 421 in the direction in which the elastic element 41 is pushed.

Figure 6:
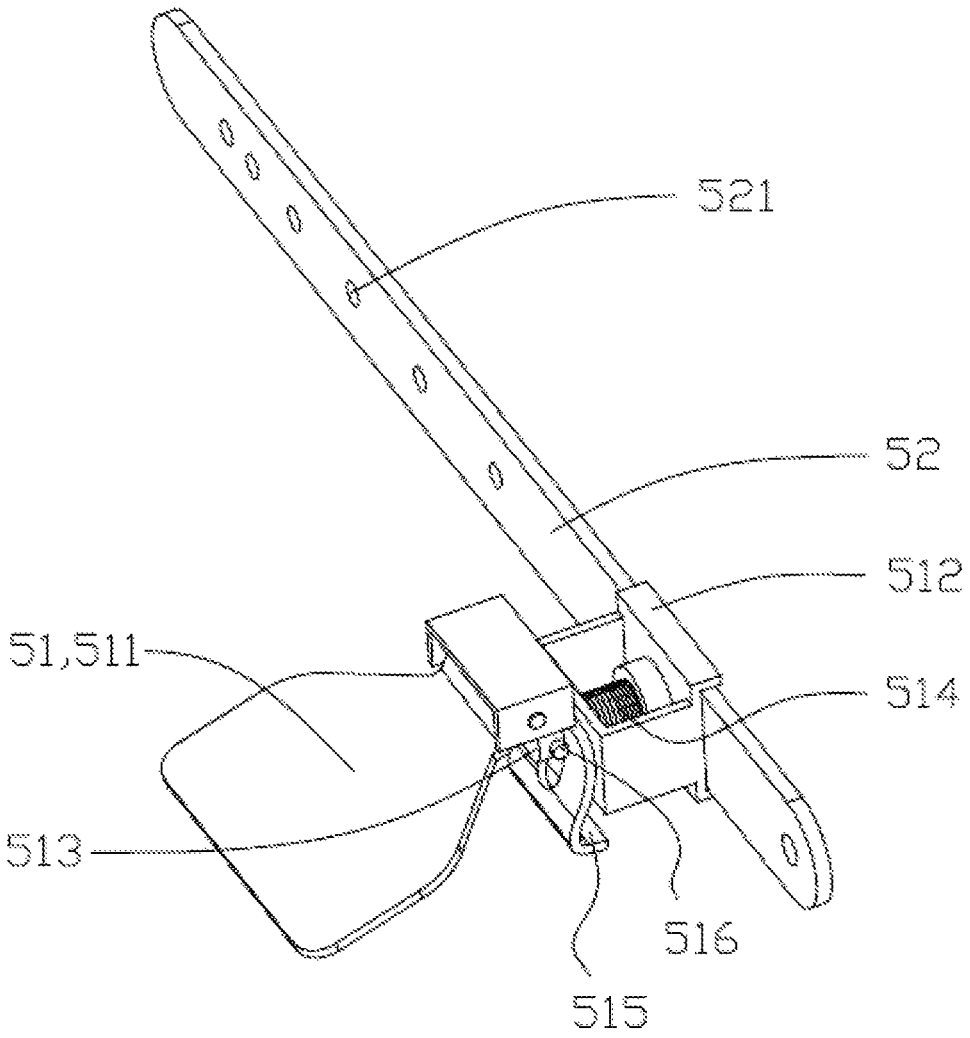
FIG. 6 is a structural diagram of a locking assembly according to the first embodiment of the present invention.
Figure 7:
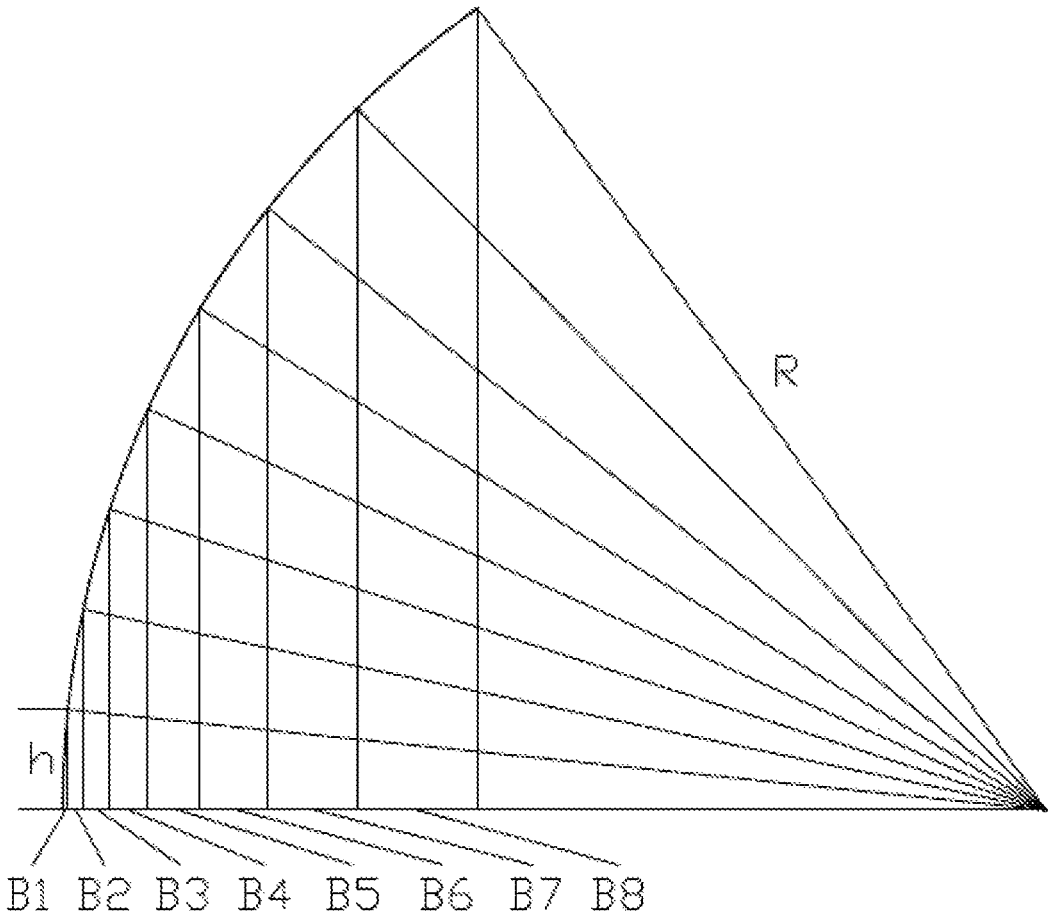
FIG. 7 is a relationship graph between the interval of locking holes and the unit lifting height when the unit lifting height of the desktop is equidistant according to the first embodiment of the present invention.
Figure 8:
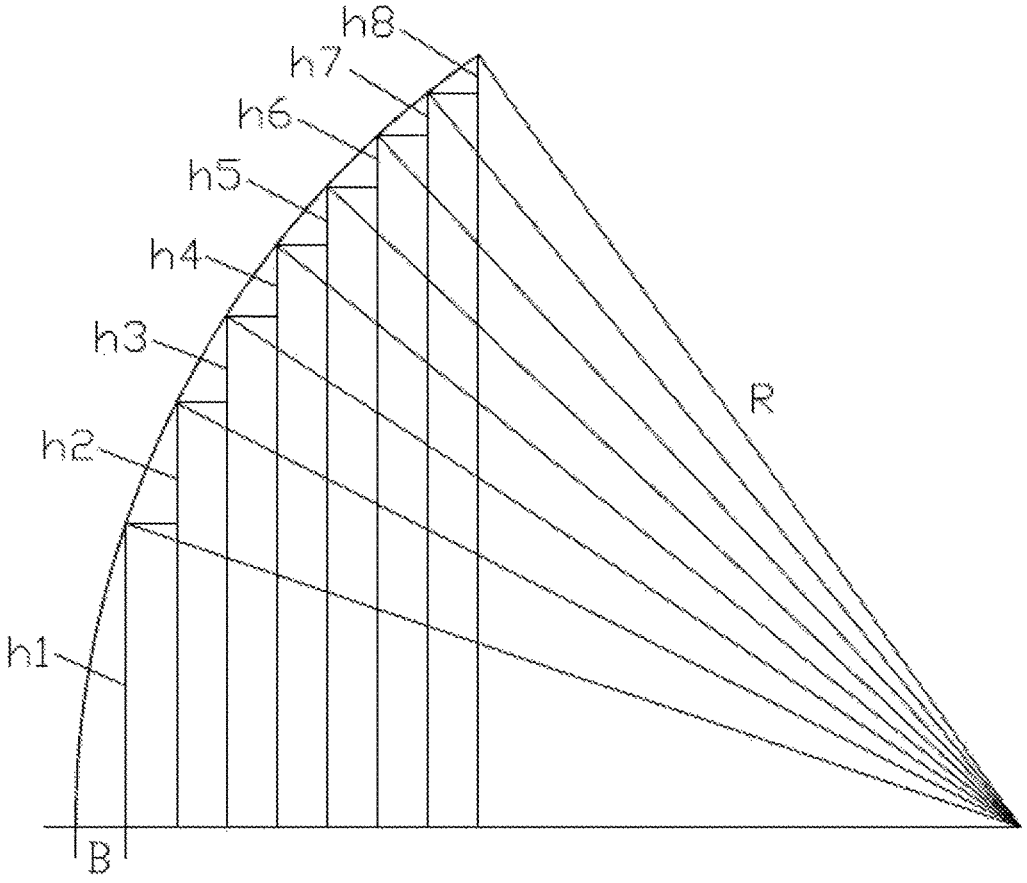
FIG. 8 is a relationship graph between the unit lifting height and the interval of locking holes when the interval of locking holes is equidistant according to the first embodiment of the present invention.

Referring to FIG. 6, the locking assemblies 5 are used for positioning the lifting height of the lifting desktop. In order to simplify the product structure and improve the service reliability of the product, the locking assemblies 5 in the present invention employ the method of positioning the lifting height stepwise, i.e., stepped locking. Each of the locking assemblies 5 includes a pin assembly 51 arranged below the desktop platform 1 and a locking bar 52 having one end connected to the free end 312 of the support leg 31 to move backward and forward along with the free end 312. Eight locking pin holes 521 are formed on the locking bar 52. A user positions the height of the lifting desktop by controlling the fitting of a locking pin 513 in the pin assembly 51 with the locking pin holes 521. The pin assembly 51 includes a locking pin bracket 512 fixed on an outer side of the middle of the upper side-plate 111, a locking pin 513 slidingly connected to the locking pin bracket 512 and a return spring 514 for resetting the locking pin 513. A slideway is provided between the locking pin bracket 512 and the connected upper side-plate 111, the locking bar 52 is slidingly provided within the slideway, and the locking pin 513 is fitted with the locking pin hole 521 on the locking bar 52. A transverse pin hole is formed on a portion of the locking pin 513 extending out of the locking pin bracket 512, and a transverse pin 516 is provided within the transverse pin hole. A locking pin press plate 511 is pivoted on the bottom of the desk panel 12 at a position corresponding to the locking pin bracket 512. The locking pin press plate is bent in form of an L-shape. One edge of the locking pin press plate has an included angle with the bottom surface of the desk panel 12, while the other edge thereof is arc; and, a notch is formed in the middle of the locking pin press plate. The notch of the press plate 511 is clamped in the portion of the locking pin 513 extending out of the locking pin bracket 512, and located between the locking pin bracket 512 and the transverse pin 516. By pressing the press plate 511, the locking pin 513 may be disengaged from the locking pin hole 521; and then, according to a desired height, the locking pin 513 is automatically snapped into the locking pin hole 512 corresponding to the desired height by the return spring 514. Referring to FIG. 7, in this embodiment, the desktop is lifted equidistantly stepwise, and the interval B between the locking holes progressively increases stepwise. If it is assumed that each unit lifting height of the desktop platform is h, the half length of the support leg is R and the step number is n, the interval B between the locking holes arranged as follows according to the step number n: $B_n=R-\sqrt{R^2-(nh)^2}-B_{n-1}$. Referring to FIG. 8, conversely, when the locking holes 521 are arranged stepwise at an equal interval B, the unit lifting height h of the desktop platform increases progressively. The unit lifting height arranged stepwise according to the step number n is as follows: $h_n=R-\sqrt{R^2-(R-nB)^2}-h_{n-1}$.

Due to the action of the actuating lever 42, when the support frame assemblies 3 are folded to allow the bottom of the desktop platform to resist against the roller 44 at the free end of the ram portion 422, the support frame assemblies 3 will be subject to a rebound force. When the support frame assemblies 3 are completely folded, since the interval between the locking pin holes 521 on the locking bar 52 of the locking assembly 5 is too small, it is difficult to lock the desktop platform in the completely folded state by the locking pin 513. Therefore, in the locking assembly 5, a lock catch 53 is provided at a corresponding position on the lower side-plate 21 and a locking hook 515 fitted with the lock catch 55 is provided on the press plate 511, so as to lock the completely folded support frame assemblies 3.

Embodiment 2

A difference between this embodiment and Embodiment 1 lies in a variation of the assistance assemblies 4.

Figure 9:
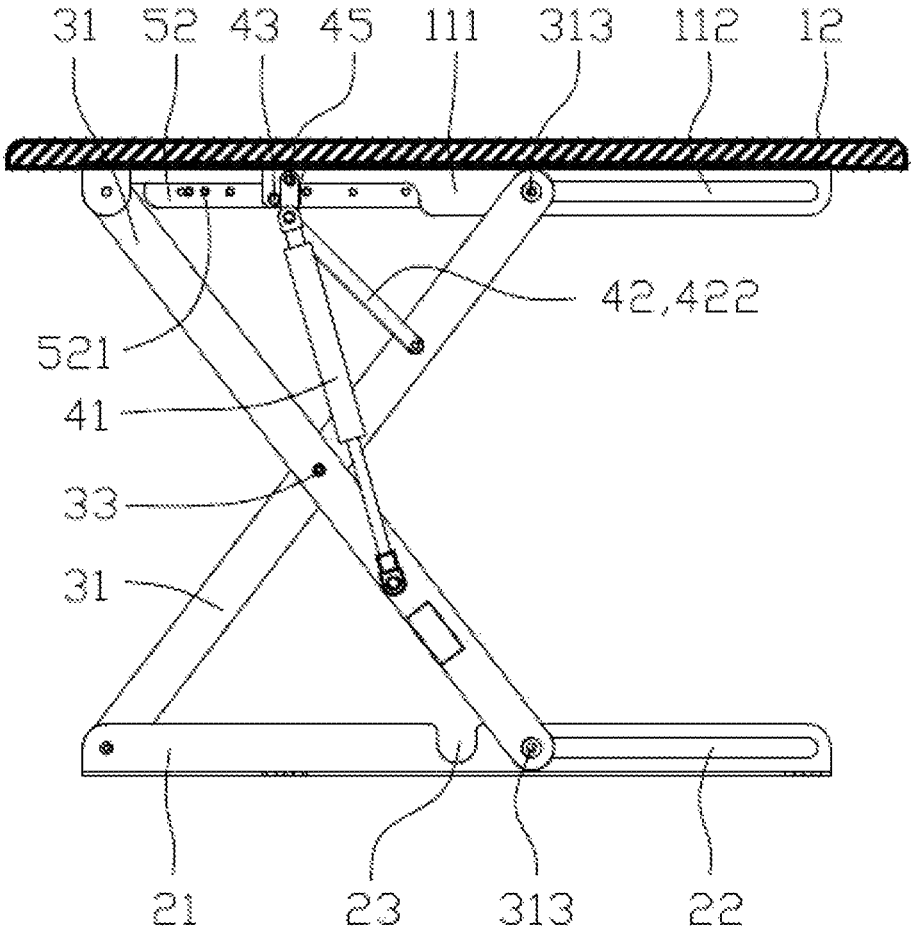
FIG. 9 is a structural diagram according to a second embodiment of the present invention, where another connection way of an assistance assembly is shown.

Referring to FIG. 9, in this embodiment, the fulcrum pivot 45 of the actuating lever 42 in each of the assistance assemblies 4 is a free end of the arm-of-force portion 421. The actuating lever 42 is pivoted to the upper side-plate 111 by the fulcrum pivot 45, one end of the elastic element 41 is pivoted to a junction of the arm-of-force portion 421 and the ram portion 422, and the ram portion 422 tends to resist against a plane bearing the base frame 2. The other end of the elastic element 41 is pivoted to a portion close to the free ends 312 of the support legs 31, of which the fixed pivot ends 311 are pivoted to the same upper side-plates 111. In this embodiment, if the included angle between the arm-of-force portion 421 and the ram portion 422 of the actuating lever 42 is also an obtuse angle, the ram portion 422 is oriented to an inner side of the support frame assemblies 3; and otherwise, the ram portion 422 is oriented to an outer side of the support frame assembly 3.

Embodiment 3

Figure 10:
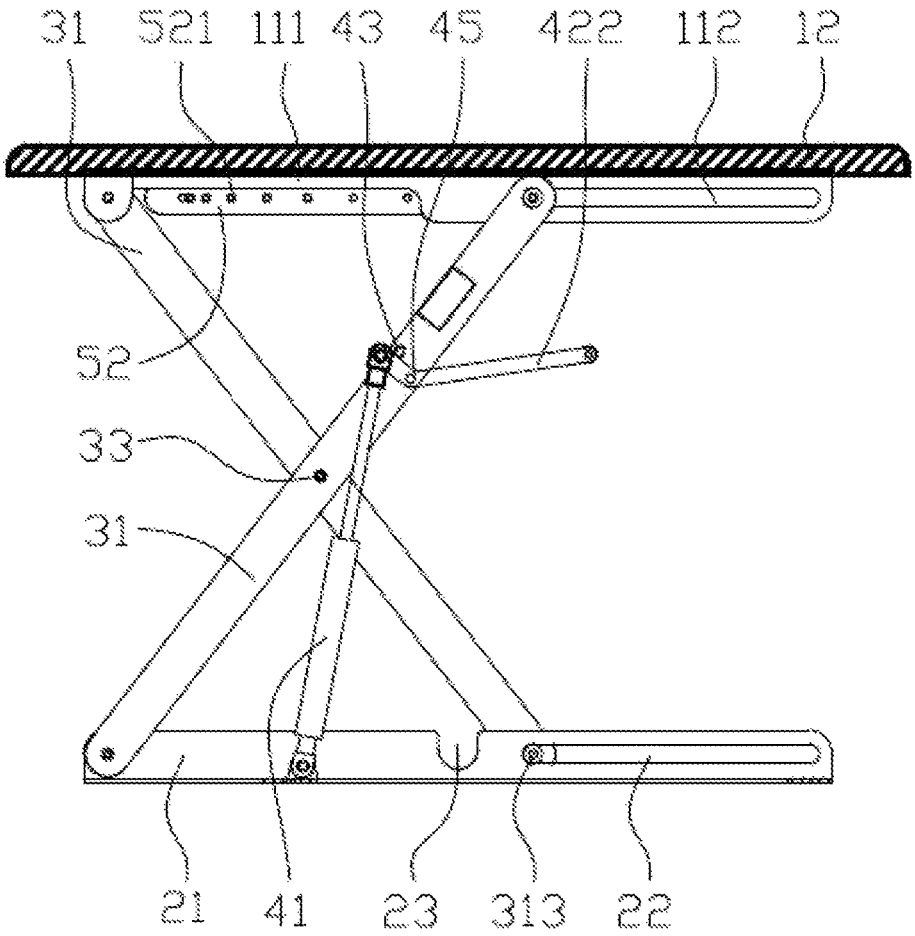
FIG. 10 is a structural diagram according to a third embodiment of the present invention, where still another connection way of an assistance assembly is shown.

A difference between this embodiment and Embodiment 1 lies in a variation of the assistance assemblies 4. Referring to FIG. 10, in this embodiment, one end of the elastic element 41 in each of the assistance assemblies 4 is pivoted to the lower side-plate 21; the fulcrum pivot 45 of the actuating lever 42 is also arranged at a junction of the arm-of-force portion 421 and the ram portion 422 and pivoted to a portion close to the free end 312 of the support legs 31, of which the fixed pivot end 311 are pivoted to the same lower side-plate 21; and the other end of the elastic element 41 is pivoted to the free end of the arm-of-force portion 421 of the actuating lever 42. In this embodiment, if the included angle between the arm-of-force portion 421 and the ram portion 422 of the actuating lever 42 is also an obtuse angle, the ram portion 422 is oriented to an outer side of the support frame assemblies 3; and otherwise, the ram portion 422 is oriented to an inner side of the support frame assemblies 3.

Embodiment 4

Figure 11:
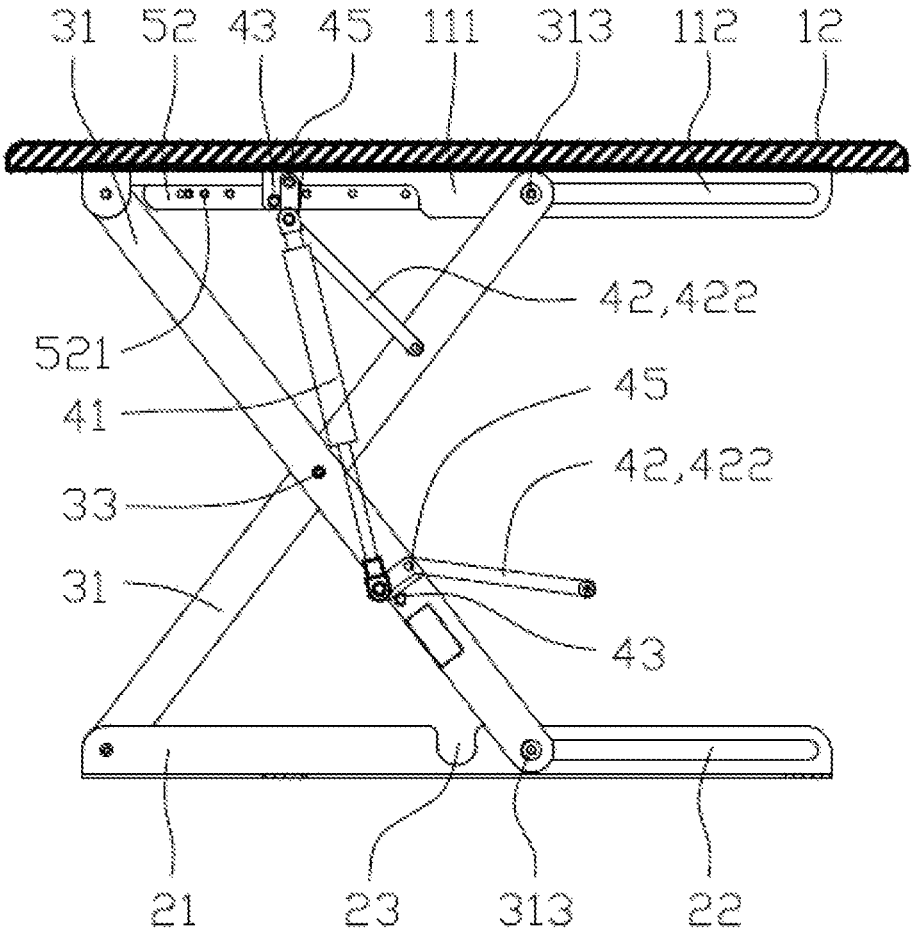
FIG. 11 is a structural diagram according to a fourth embodiment of the present invention, where still another connection way of an assistance assembly is shown and actuating levers are provided at two ends of an elastic element.

A difference between this embodiment and embodiment 1 lies in a variation of the assistance assemblies 4. referring to FIG. 11, in this embodiment, the actuating lever 42 in each of the assistance assemblies 4 is designed with reference to the ideas in embodiment 1 and 2. The elastic element 41 is arranged at the position as described in embodiment 1, but actuating levers 42 are provided at both ends of the elastic element 41. By additionally providing the actuating levers 42, the actuating force in the folded state may be improved.

The specific embodiment are merely for understanding the present invention more clearly and are not intended to limit the patent right of the present invention. Various variations may be made without departing from the concept of the present invention, and all modifications apparent for those skilled in the art shall fall into the scope of the claims.

What is claimed is:

1. A lifting desktop with a compact structure, comprising a desktop platform, a base frame below the desktop platform, and two sets of support frame assemblies, assistance assemblies and locking assemblies which are symmetrically arranged on two sides between the base frame and the desktop platform, the base frame comprising lower side-plates, the desktop platform comprising upper side-plates, wherein each of the support frame assemblies comprises two support legs which are pivoted to each other in scissors by a central pivot and spanned on two sides of the respective lower side-plate; each of the support legs has a fixed pivot end pivoted to the respective lower side-plate or upper side-plate and a free end movably connected to the opposite upper side-plate or lower side-plate on the same side: one end of each of the assistance assemblies is pivoted to the support leg on a side close to the free end, while the other end thereof is pivoted to the lower side-plate or upper side-plate on a side of the fixed pivot end of the same support leg; and, central slots for accommodating the central pivot are provided on the lower side-plates, wherein each of the assistance assemblies comprises an elastic element and an actuating lever at least pivoted to one end of the elastic element; the actuating lever is provided with a ram portion and an arm-of-force portion, a fulcrum pivot is provided on the arm-of-force portion, and the elastic element is pivoted onto the arm-of-force portion, so that a thrust force applied to the arm-of-force portion by the elastic element allows the ram portion to rotate about the fulcrum pivot towards a plane bearing the base frame or a bottom surface of the desktop platform; and, the elastic element comprises a pneumatic cylinder, a hydraulic cylinder or a compression spring.

2. The lifting desktop according to claim 1, further comprising a limiting pin for limiting the swing angle for the rotation of the actuating lever, wherein the swing angle of the actuating lever about the fulcrum pivot is 60° to 120°.

3. The lifting desktop according to claim 2, wherein the swing angle of the actuating lever relative to the fulcrum pivot is 90°.

4. The lifting desktop according to claim 1, wherein a movable connection structure for the free end of each of the support legs comprises an upper sliding chute provided on the upper side-plate, a lower sliding chute provided on the lower side-plate on the same side, and a sliding pin provided at the free end of the support leg.

5. The lifting desktop according to claim 4, wherein each of the locking assemblies comprises a pin assembly arranged on the bottom surface of the desktop platform and a locking bar connected to the free end of the support leg; a number of locking pin holes are provided on the locking bar, and the locking pin holes are arranged at an equal interval B; the unit lifting height of the desktop is stepped: $h_n=R-\sqrt{R^2-(R-nB)^2}-h_{n-1}$, where n is the step number, B is the interval between the locking pin holes and R is the half length of the support leg.

6. The lifting desktop according to claim 5, wherein each of the locking assemblies further comprises a locking hook provided at a head end of a press plate of the pin assembly and a lock catch which is provided on the lower side-plate and corresponds to and adapts to the locking hook.

7. The lifting desktop according to claim 4, wherein the desktop platform is lifted equidistantly stepwise; each of the locking assemblies comprises a pin assembly arranged on the bottom surface of the desktop platform and a locking bar connected to the free end of the support leg; a number of locking pin holes are provided on the locking bar, and the locking pin holes are arranged at an equal interval B: $B_n=R-\sqrt{R^2-(nh)^2}-B_{n-1}$, where R is the half length of the support leg, h is the unit limiting height and n is the step number.

8. The lifting desktop according to claim 7, wherein each of the locking assemblies further comprises a locking hook provided at a head end of a press plate of the pin assembly and a lock catch which is provided on the lower side-plate and corresponds to and adapts to the locking hook.

9. The lifting desktop according to claim 1, wherein each of the locking assemblies comprises a pin assembly arranged on the bottom surface of the desktop platform and a locking bar connected to the free end of the support leg; a number of locking pin holes are formed on the locking bar, and the locking pin holes are arranged at an equal interval B; the unit lifting height of the desktop is stepped: $h_n=R-\sqrt{R^2-(R-nB)^2}-h_{n-1}$, where n is the step number, B is the interval between the locking pin holes and R is the half length of the support leg.

10. The lifting desktop according to claim 9, wherein each of the locking assemblies further comprises a locking hook provided at a head end of a press plate of the pin assembly and a lock catch which is provided on the lower side-plate and corresponds to and adapts to the locking hook.

11. The lifting desktop according to claim 1, wherein the desktop platform is lifted equidistantly stepwise; each of the locking assemblies comprises a pin assembly arranged on the bottom surface of the desktop platform and a locking bar connected to the free end of the support leg; a number of locking pin holes are formed on the locking bar, and the locking pin holes are arranged at an equal interval B: $B_n=R-\sqrt{R^2-(nh)^2}-B_{n-1}$, where R is the half length of the support leg, h is the unit limiting height and n is the step number.

12. The lifting desktop according to claim 11, wherein each of the locking assemblies further comprises a locking hook provided at a head end of a press plate of the pin assembly and a lock catch which is provided on the lower side-plate and corresponds to and adapts to the locking hook.

13. A lifting desktop with a compact structure, comprising a desktop platform, a base frame below the desktop platform, and two sets of support frame assemblies and locking assemblies which are arranged between the desktop platform and the base frame, wherein a pneumatic cylinder and an actuating lever are provided between the desktop platform and the base frame; an upper end of the pneumatic cylinder is pivoted to the desktop platform; the actuating lever is a rod with obtuse corner consisting of an arm-of-force portion and a ram portion, and the actuating lever is pivoted onto the support frame assemblies by using its corner as a fulcrum pivot; a free end of the arm-of-force portion is pivoted to a lower end of the pneumatic cylinder; and, a free end of the ram portion can act on a bottom surface of the desktop platform in the starting stage of unfolding the support fame assemblies.

14. The lifting desktop according to claim 13, wherein the desktop platform comprises upper side-plates separately arranged on two sides, and the base frame comprises lower side-plates separately arranged on two sides; each of the support frame assemblies comprises two support legs which are pivoted to each other in scissors by a central pivot and spanned on two sides of a lower side-plate of the base frame; each of the support legs has a fixed pivot end pivoted to the lower side-plate or upper side-plate and a free end movably connected to the opposite upper side-plate or lower side-plate on the same side; and, a central slot for accommodating the central pivot is provided in the middle of each of the lower side-plates.

15. The lifting desktop according to claim 14, wherein a movable connection structure for the free end of each of the support legs comprises an upper sliding chute provided on the upper side-plate, a lower sliding chute provided on the lower side-plate on the same side, and a sliding pin provided at the free end of the support leg.

16. The lifting desktop according to claim 14, wherein the desktop platform is lifted equidistantly stepwise; each of the locking assemblies comprises a pin assembly arranged on the bottom surface of the desktop platform and a locking bar connected to the free end of the support leg; a number of locking pin holes are provided on the locking bar, and the locking pin holes are arranged at an equal interval B: $B_n=R-\sqrt{R^2-(nh)^2}-B_{n-1}$, where R is the half length of the support leg, h is the unit limiting height and n is the step number, wherein the included angle between the arm-of-force portion and the ram portion of the actuating lever is 120° to 150° or 135°, wherein each of the locking assemblies further comprises a locking hook provided at a head end of a press plate of the pin assembly and a lock catch which is provided on the lower side-plate and corresponds to and adapts to the locking hook.

17. The lifting desktop according to claim 14, wherein each of the locking assemblies comprises a pin assembly arranged on the bottom surface of the desktop platform and a locking bar connected to the free end of the support leg; a number of locking pin holes are provided on the locking bar, and the locking pin holes are arranged at an equal interval B; the unit lifting height of the desktop is stepped: $h_n=R-\sqrt{R^2-(R-nB)^2}-h_{n-1}$, where n is the step number, B is the interval between the locking pin holes and R is the half length of the support leg, wherein the included angle between the arm-of-force portion and the ram portion of the actuating lever is 120° to 150° or 135°, wherein each of the locking assemblies further comprises a locking hook provided at a head end of a press plate of the pin assembly and a lock catch which is provided on the lower side-plate and corresponds to and adapts to the locking hook.

18. The lifting desktop according to claim 13, wherein the included angle between the arm-of-force portion and the ram portion of the actuating lever is 120° to 150°.

19. The lifting desktop according to claim 18, wherein the included angle between the arm-of-force portion and the ram portion of the actuating lever is 135°.

* * * * *